US008641041B2

(12) United States Patent
Lee et al.

(10) Patent No.: US 8,641,041 B2
(45) Date of Patent: Feb. 4, 2014

(54) PRINTING MEDIUM SUPPLYING APPARATUS AND IMAGE FORMING APPARATUS HAVING THE SAME

(75) Inventors: Jin-soo Lee, Suwon-si (KR); Jae-yong Kim, Anseong-si (KR)

(73) Assignee: Samsung Electronics Co. Ltd., Suwon-si (KR)

( * ) Notice: Subject to any disclaimer, the term of this patent is extended or adjusted under 35 U.S.C. 154(b) by 0 days.

(21) Appl. No.: 13/354,534

(22) Filed: Jan. 20, 2012

(65) Prior Publication Data

US 2012/0112399 A1 May 10, 2012

Related U.S. Application Data

(63) Continuation of application No. 12/137,118, filed on Jun. 11, 2008, now Pat. No. 8,123,214.

(30) Foreign Application Priority Data

Aug. 3, 2007 (KR) ..... 2007-77943

(51) Int. Cl.
*B65H 9/04* (2006.01)

(52) U.S. Cl.
USPC ..... 271/242; 271/226; 271/245; 271/9.09; 271/9.13; 271/273; 271/167; 271/145; 399/124

(58) Field of Classification Search
USPC ..... 271/167, 169, 170, 226, 242, 245, 162, 271/164, 145, 9.01, 9.13, 273, 9.09; 399/124
See application file for complete search history.

(56) References Cited

U.S. PATENT DOCUMENTS

| | | | | |
|---|---|---|---|---|
| 3,661,383 | A * | 5/1972 | Morrison | 271/273 |
| 5,002,266 | A * | 3/1991 | Kikuchi et al. | 271/3.2 |
| 5,326,091 | A * | 7/1994 | Giacometto et al. | 271/10.01 |
| 5,383,655 | A * | 1/1995 | Hayakawa et al. | 271/10.01 |
| 5,615,872 | A * | 4/1997 | Mochimaru | 271/3.14 |
| 7,444,112 | B2 * | 10/2008 | Murakami et al. | 399/392 |
| 2002/0030321 | A1 * | 3/2002 | Sugiyama et al. | 271/226 |
| 2002/0060389 | A1 * | 5/2002 | Sugimura | 271/9.11 |
| 2005/0067769 | A1 * | 3/2005 | Albat et al. | 271/226 |
| 2007/0018381 | A1 * | 1/2007 | Gotoh | 271/245 |
| 2008/0093795 | A1 * | 4/2008 | Lee et al. | 271/245 |
| 2008/0118293 | A1 * | 5/2008 | Lee et al. | 399/402 |
| 2009/0283965 | A1 * | 11/2009 | Sekiya | 271/226 |

OTHER PUBLICATIONS

Chinese Office Action Issued on Mar. 31, 2012 in CN Patent Application No. 200810135205.5.
Chinese Office Action issued Aug. 25, 2011 in CN Application No. 200810135205.5.
Korean Office Action dated Nov. 30, 2011 issued in KR Application No. 10-2007-0077943.

* cited by examiner

*Primary Examiner* — Prasad Gokhale
(74) *Attorney, Agent, or Firm* — Stanzione & Kim, LLP

(57) ABSTRACT

A printing medium supplying apparatus for an image forming apparatus includes an apparatus main body, and a printing medium aligning unit which is disposed on the apparatus main body to move between an aligning position at which the printing medium aligning unit aligns a printing medium and a distanced position at which the printing medium aligning unit is distanced from the aligning position.

22 Claims, 13 Drawing Sheets

PRINTING MEDIUM SUPPLYING APPARATUS AND IMAGE FORMING APPARATUS HAVING THE SAME

CROSS-REFERENCE TO RELATED APPLICATIONS

This application is a Continuation Application of prior application Ser. No. 12/137,118, filed on Jun. 11, 2008 now U.S. Pat. No. 8,123,214 in the United States Patent and Trademark Office, which claims priority from Korean Patent Application No. 10-2007-0077943, filed on Aug. 3, 2007 in the Korean Intellectual Property Office, the disclosure of which is incorporated herein by reference in its entirety.

BACKGROUND OF THE INVENTION

1. Field of the Invention

The present general inventive concept relates to a printing medium supplying apparatus and an image forming apparatus having the same, and more particularly, to a printing medium supplying apparatus and an image forming apparatus having the same including a printing medium aligning unit.

2. Description of the Related Art

An image forming apparatus forms an image on a printing medium, and may be classified as an ink jet type discharging an ink, an electrophotographic type having charging, exposing, developing, transferring and cleaning processes, and a thermal transfer type using an ink ribbon.

FIG. 1 is a schematic sectional view of a conventional image forming apparatus 1 of the electrophotographic type.

The conventional image forming apparatus 1 includes a printing medium supplying unit 10, a printing medium aligning unit 20, an image forming unit 30, a fusing unit 40, a discharging unit 50, a printing medium transporting unit 60 and a manual paper supplying unit 70.

The printing medium supplying unit 10 includes a casing 11, a plate 13 accommodated to the casing 11 to be loaded with a printing medium P, an elastic member 15 elastically supporting the plate 13, and a friction pad 17 preventing the printing medium P loaded on the plate 13 from being doubly transported by means of a friction force. Also, the printing medium supplying unit 10 slidably moves in a sliding direction A to be detachably mounted to a main body 2 of the image forming apparatus 1. The printing medium P loaded on the plate 13 is picked up by a pickup roller 12, and is individually separated by the friction pad 17 to be transported to feeding rollers 53 and 55.

The printing medium aligning unit 20 includes a pair of aligning rollers 23 and 25. A front end part of the printing medium P transported by the feeding rollers 53 and 55 bumps against the pair of rollers 23 and 25 maintaining a stop state so that the printing medium P can be aligned.

After aligning the printing medium P, the aligning rollers 23 and 25 rotate to supply the aligned printing medium P to the printing medium transporting unit 60.

The printing medium transporting unit 60 includes a belt 61, and a driving roller 63 and driven rollers 65 circulating the belt 61 in orbit. The printing medium P transported by the aligning rollers 23 and 25 is attracted to the belt 61 to pass between a photosensitive body 37 and a transferring roller 39 of the image forming unit 30.

The image forming unit 30 may include a plurality of developing cartridges 30Y, 30M, 30C and 30K, and a plurality of transferring rollers 39. Each developing cartridge 30Y, 30M, 30C and 30K respectively stores yellow, magenta, cyan and black toners, and accommodates the photosensitive body 37, a charging roller 35, a developing roller 33 and a supplying roller 31. The charging roller 35 charges a surface of the photosensitive body 37, and the photosensitive body 37 having the charged surface is exposed by an exposing unit (not illustrated) so that an electrostatic latent image can be formed on the surface. The supplying roller 31 supplies the stored toner to the developing roller 33, and the developing roller 33 develops the electrostatic latent image with the supplied toner.

The electrostatic latent image developed with the toner is transferred to the printing medium P by the transferring roller 39, and then passes through the fusing unit 40 including a heating roller 41 and a pressing roller 43 to be fused on the printing medium P. The printing medium P may be supplied to the image forming unit 30 by the manual paper supplying unit 70 instead of the printing medium supplying unit 10.

The manual paper supplying unit 70 includes a manual supplying supporter 71 on which the printing medium P is loaded, a manual pickup roller 77 picking up the printing medium P of the manual supplying unit 71, and feeding rollers 73 and 75 transporting the picked up printing medium P to the printing medium aligning unit 20.

Although the conventional printing medium aligning unit 20 is securely coupled to a frame (not illustrated) inside the image forming apparatus 1, the printing medium supplying unit 10 is needed to be detachably mounted to the main body 2 to load the printing medium P on the plate 13. Accordingly, since it is necessary that the printing medium aligning unit 20 and the printing medium supplying unit 10 are disposed without interfering with each other, it is difficult to make the image forming apparatus 1 small.

Also, if the printing medium P is jammed between the manual paper supplying unit 70 and the printing medium aligning unit 20, since the printing medium aligning unit 20 is securely disposed on the frame, it is difficult to remove the jammed printing medium P.

SUMMARY OF THE INVENTION

The present general inventive concept provides a printing medium supplying apparatus and an image forming apparatus having the same making the image forming apparatus small.

The present general inventive concept also provides a printing medium supplying apparatus and an image forming apparatus having modularized components of an image forming apparatus, thereby improving productivity.

The present general inventive concept also provides a printing medium supplying apparatus and an image forming apparatus having the same to easily remove a jammed printing medium.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a printing medium supplying apparatus for an image forming apparatus, including an apparatus main body, and a printing medium aligning unit which is disposed on the apparatus main body to move between an aligning position at which the printing medium aligning unit aligns a printing medium and a distanced position at which the printing medium aligning unit is distanced from the aligning position.

The printing medium aligning unit may include an aligning member to align the printing medium, and a unit main body to rotatably support the aligning member.

The printing medium supplying apparatus may further include a locking unit to lock and to release the unit main body to and from the apparatus main body.

The locking unit may include a moving member which is provided on one of the apparatus main body and the unit main body to move between a locking position at which the unit main body is locked to the apparatus main body and a locking withdrawing position at which the unit main body is released from the apparatus main body, and a stationary member which is provided on one of the apparatus main body and the unit main body to engage with and to separate from the moving member.

The moving member may be disposed on the unit main body to slidably move.

The moving member may include an engagement protrusion, and the stationary member may include a separation allowing unit which is provided at the locking withdrawing position to allow separation of the engagement protrusion, and a separation obstructing unit which may be provided at the locking position to obstruct separation of the engagement protrusion.

The printing medium supplying apparatus may further include an elastic member to elastically bias the moving member toward the locking position.

The printing medium aligning unit may be rotatably disposed on the apparatus main body.

The printing medium supplying apparatus may further include a hinge pivot which is provided on one of the apparatus main body and the printing medium aligning unit, and a supporter which may include a hinge pivot insertion unit to allow the hinge pivot to be inserted therethrough, and a support unit to support the hinge pivot.

The foregoing and/or other aspects of the present general inventive concept may also be achieved by providing an image forming apparatus, including an image forming unit to form an image on a printing medium, and a printing medium supplying apparatus to supply the printing medium to the image forming unit including an apparatus main body, and a printing medium aligning unit which is disposed on the apparatus main body to move between an aligning position at which the printing medium aligning unit aligns the printing medium, and a distanced position at which the printing medium aligning unit is distanced from the aligning position.

The printing medium aligning unit may include an aligning member to align the printing medium, and a unit main body to rotatably support the aligning member.

The image forming apparatus may further include a locking unit to lock and to release the unit main body to and from the apparatus main body.

The locking unit may include a moving member which is provided on one of the apparatus main body and the unit main body to move between a locking position at which the unit main body is locked to the apparatus main body and a locking withdrawing position at which the unit main body is released from the apparatus main body, and a stationary member which is provided to engage with and separate from the moving member.

The moving member may be disposed on the unit main body to slidably move.

The moving member may include an engagement protrusion, and the stationary member may include a separation allowing unit which is provided on the locking withdrawing position to allow separation of the engagement protrusion, and a separation obstructing unit which is provided on the locking position to obstruct separation of the engagement protrusion.

The locking unit may further include an automatic locking unit to move the moving member to the locking position as the unit main body moves to the aligning position.

The automatic locking unit may further include an elastic member to elastically bias the moving member toward the locking position.

The printing medium aligning unit may be rotatably disposed on the apparatus main body.

The image forming apparatus may further include a hinge pivot which is provided on one of the apparatus main body and the printing medium aligning unit, and a supporter which includes a hinge pivot insertion unit which is provided to allow the hinge pivot to be inserted therethrough, and a support unit to support the hinge pivot.

The foregoing and/or other aspects of the present general inventive concept may also be achieved by providing printing medium supplying device including a printing medium supplying device main body, an aligning unit rotatably attached to the main body to align a printing medium and to move between an aligning position and a non-aligning position, a movable locking unit to lock and unlock the aligning unit to and from the printing medium supplying device main body, the movable locking unit including a stationary member and a moving member to move in relation to the stationary member and having an engagement protrusion portion to engage with the stationary member to prevent separation of the engagement protrusion portion from the stationary member as the moving member moves.

BRIEF DESCRIPTION OF THE DRAWINGS

These and/or other aspects and utilities of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
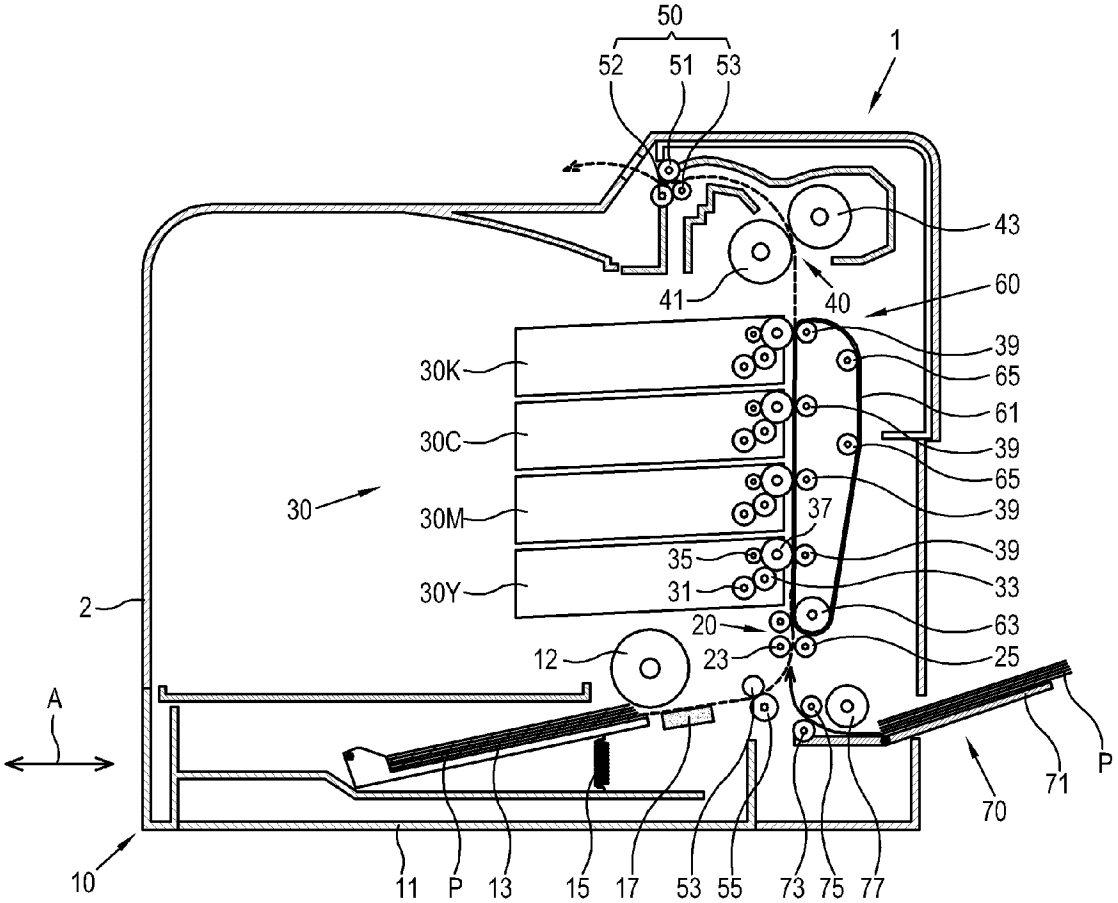
FIG. 1 (RELATED ART)
FIG. 1 is a schematic sectional view of a conventional image forming apparatus.

Reference will now be made in detail to the embodiments of the present general inventive concept, examples of which are illustrated in the accompanying drawings, wherein like reference numerals refer to like elements throughout. The embodiments are described below so as to explain the present general inventive concept by referring to the figures.

Figure 2:
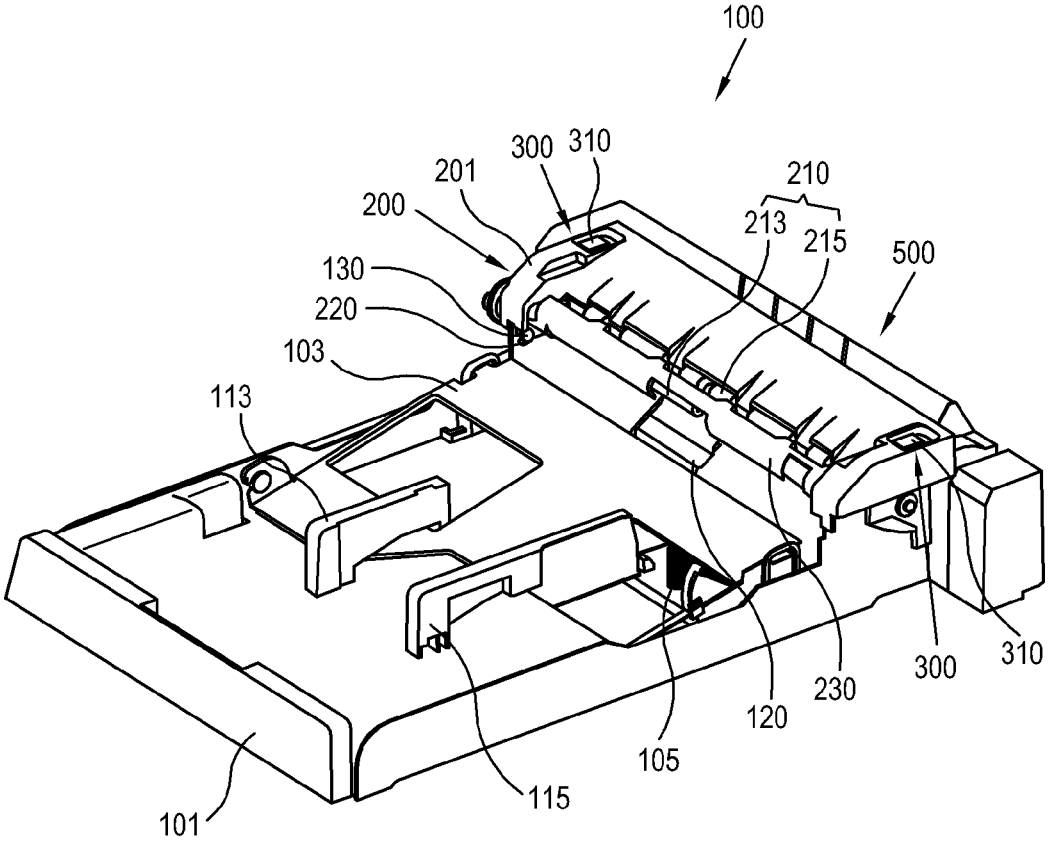
FIG. 2 is a schematic perspective view of a printing medium supplying apparatus according to an exemplary embodiment of the present general inventive concept.

As illustrated in FIG. 2, a printing medium supplying apparatus 100 according to an exemplary embodiment of the present general inventive concept includes an apparatus main body 101, and a printing medium supplying unit 200. Also, the printing medium supplying apparatus 100 includes a plate 103 disposed on the apparatus main body 101 and loaded with a printing medium, The printing medium supplying apparatus 100 may further include a pair of guide members 113 and 115 to guide opposite sides of the printing medium (not illustrated) loaded on the plate 103 depending on the size of the printing medium, and a plate elastic member 105 to elastically support a front end part of the plate 103 toward a friction pad 120.

Figure 3:
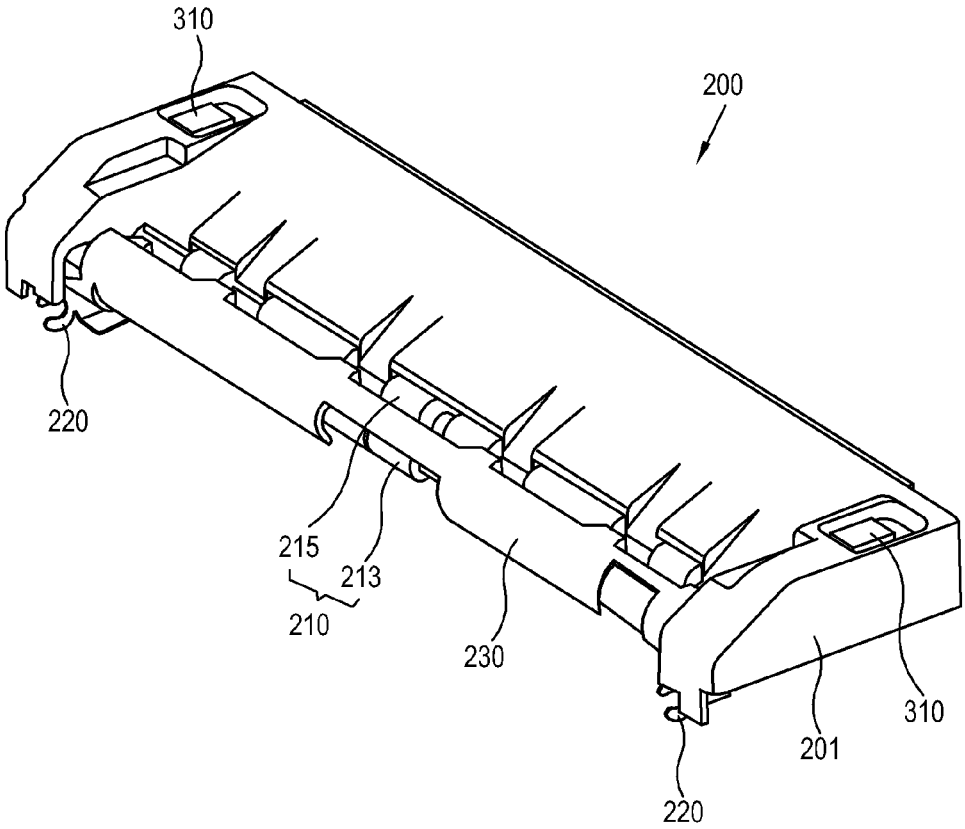
FIG. 3 is an enlarged perspective view of a printing medium aligning unit of the printing medium supplying apparatus of FIG. 2.

The printing medium aligning unit 200 includes a unit main body 201, and an aligning member 210 disposed on the unit main body 201 to align the printing medium loaded on the plate 103. As illustrated in FIGS. 2 and 3, the aligning member 210 may be provided as a pair of aligning rollers 213 and 215.

One of the aligning rollers 213 and 215 may be provided as a driving roller, and the other thereof may be provided as a driven roller. A driving gear (not illustrated) may be disposed to an end part of a rotation shaft (not illustrated) of a driving roller to receive a driving force. A transmitting gear (not illustrated) may be disposed on the apparatus main body 101 of the printing medium supplying apparatus 100 to transmit a driving force to the driving gear. The driving gear may be engaged and released to and from the transmitting gear as the printing medium aligning unit 200 moves between an aligning position and a distanced position described below.

Figure 4:
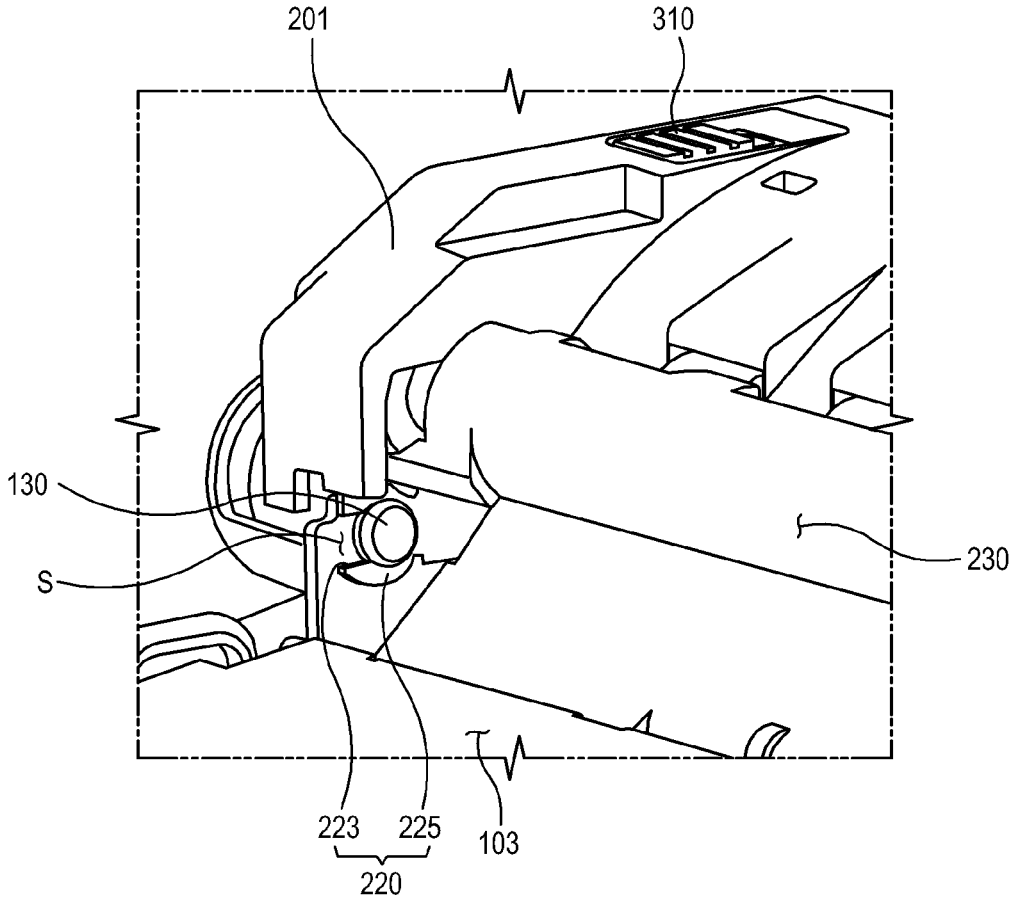
FIG. 4 is an enlarged perspective view of a main portion of the printing medium supplying apparatus of FIG. 2.

The printing medium aligning unit 200 is detachably disposed on the apparatus main body 101. As illustrated in FIGS. 3 and 4, the printing medium aligning unit 200 may further include a supporter 220 coupled to the unit main body 201 to enable the unit main body 201 to rotate with respect to the apparatus main body 101.

The supporter 220 includes a hinge pivot insertion unit 223 to which a hinge pivot 130 protruding from opposite sides of the apparatus main body 101 is inserted, and a support unit 225 rotatably supporting the hinge pivot 130.

The hinge pivot insertion unit 223 allows a user to simply mount and detach the printing medium aligning unit 200 to and from the apparatus main body 101. That is, if the user rotates the printing medium aligning unit 200 from an aligning position, illustrated in FIG. 5 to a distanced position, illustrated in FIGS. 6 and 7, and pulls the printing medium aligning unit 200 upward, the hinge pivot 130 is released from the hinge pivot insertion unit 223 so that the printing medium aligning unit 200 can be easily detached from the apparatus main body 101. Also, if the user rotates the printing medium aligning unit 200 to the aligning position after inserting the hinge pivot insertion unit 223 into the hinge pivot 130 through the supporter 220 in the distanced position, the printing medium aligning unit 200 is again mounted securely to the apparatus main body 101.

Figure 6:
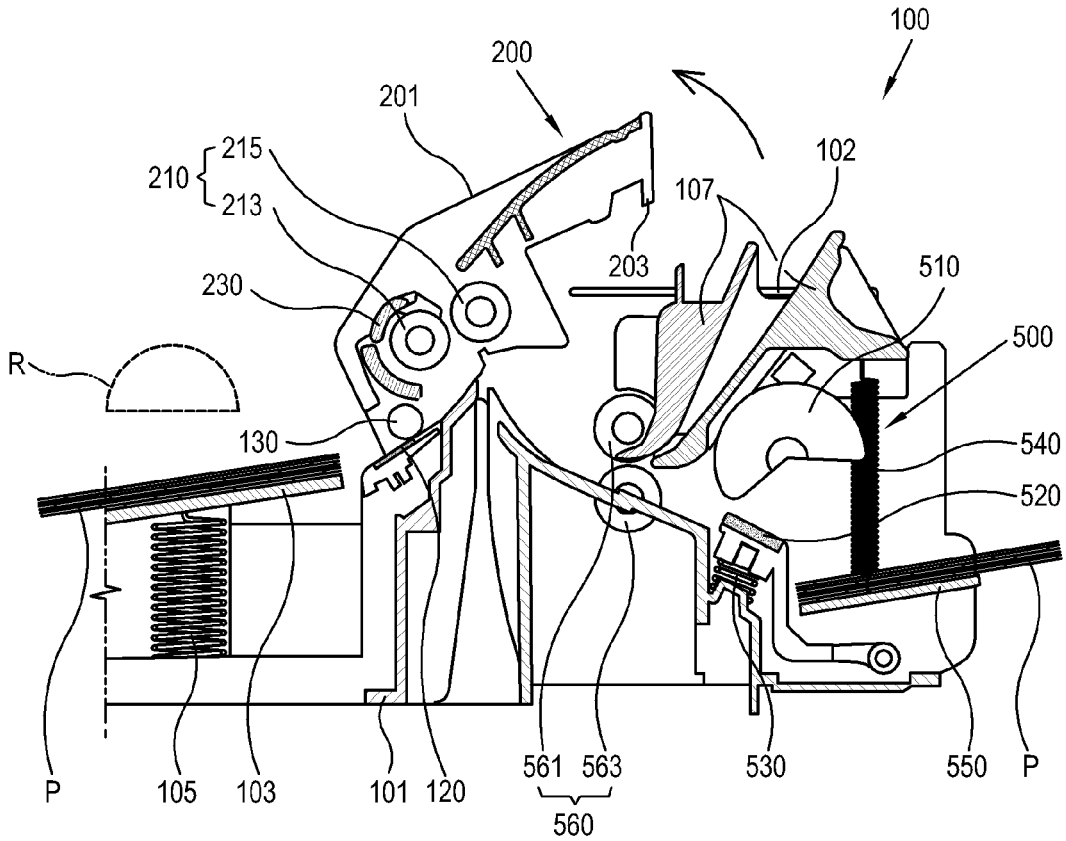
FIGS. 6 and 7 are schematic perspective views illustrating a rotation sequence of the printing medium supplying apparatus of FIG. 2 to a distanced position.
Figure 7:
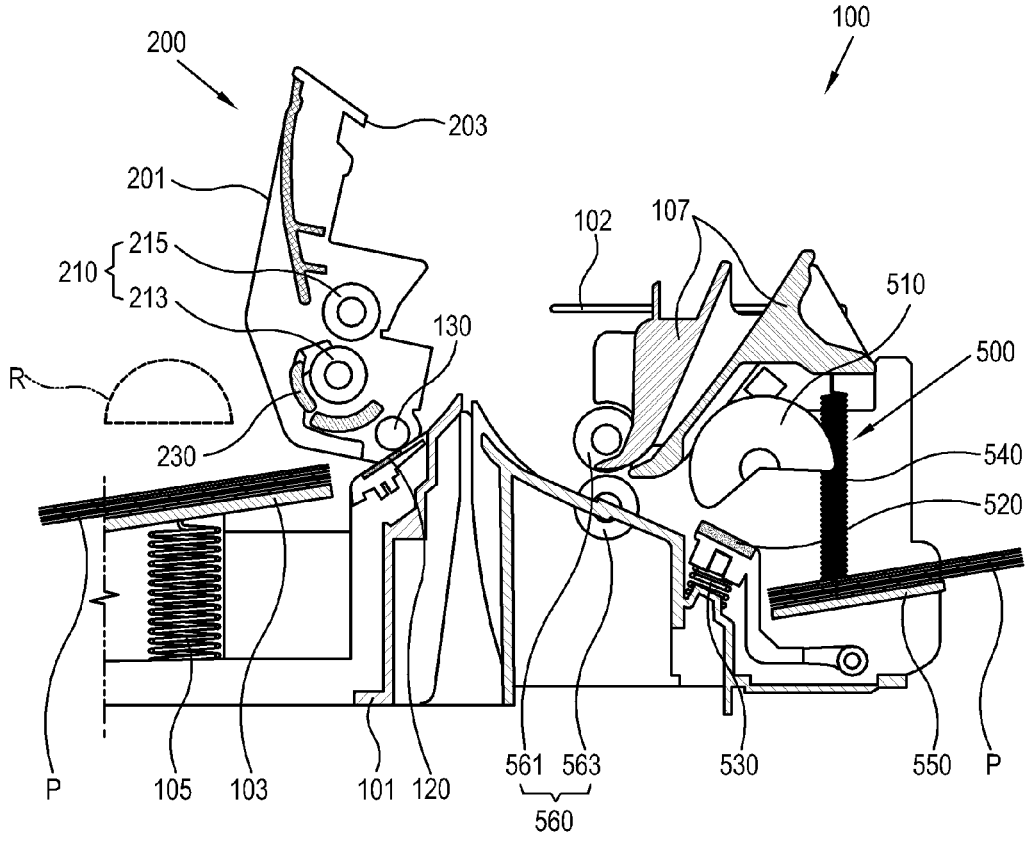

As illustrated in FIGS. 6 and 7, if a stopper 203 of the unit main body 210 contacts a contact unit 102 of the apparatus main body 101, the printing medium aligning unit 200 is prevented from rotating to be positioned at the aligning position.

Figure 5:
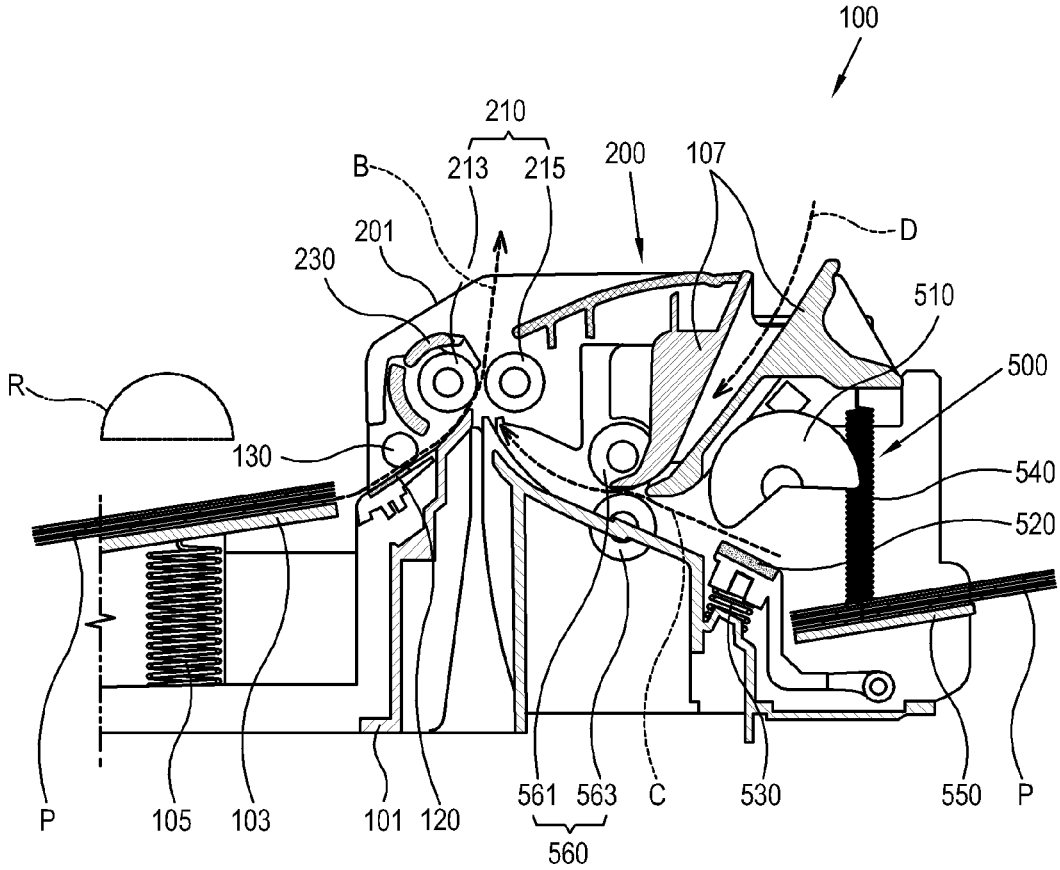
FIG. 5 is a schematic sectional view illustrating the printing medium aligning unit of the printing medium supplying apparatus of FIG. 2 which is positioned at an aligning position.

FIGS. 5 to 7 are schematic sectional views of the printing medium supplying apparatus 100 in an embodiment where the printing medium aligning unit 200 is rotated from the aligning position to the distanced position. Hereinafter, an operating process will be described by referring to FIGS. 5 to 7.

As illustrated in FIG. 5, if the printing medium supplying apparatus 100 is mounted to an image forming apparatus (not illustrated) after the printing medium aligning unit 200 is positioned at the aligning position in the apparatus main body 101, a printing medium P loaded on the plate 103 is capable of being printed.

In detail, if a pickup roller R disposed on a main body (not illustrated) of the image forming apparatus picks up the printing medium P, a front end part of the picked up printing medium contacts the friction pad 120 so that the printing medium P can be individually separated and be transported to the aligning member 210.

As illustrated in FIG. 5, the aligning member 210 maintains a stop state, where opposite front end parts of the printing medium transported by the pickup roller R bump up against the aligning member 210 so that the printing medium P can be aligned. The aligned printing medium P is transported along a transportation direction B to pass through an image forming unit (not illustrated) provided in an upper portion of the image forming device so that an image can be formed.

As illustrated in FIG. 5, if double-sided printing is needed, a double-sided printing guiding member 107 to guide the printing medium P is provided, and one side of the printing medium P which is aligned by the aligning member 210 may be then further provided to the apparatus main body 101 to be printed on one side. The double-sided printing guiding member 107 connects with a double-sided printing path D formed inside the image forming apparatus to guide the printing medium which has been printed on one side to be printed on the opposite side by the image forming unit by providing again the one side printed printing medium to the aligning member 210.

Also, as illustrated in FIGS. 2 and 5, the printing medium supplying apparatus 100 may further include a manual supplying apparatus 500.

The manual supplying apparatus 500 may include a manual pickup roller 510, a friction pad 520, a friction pad elastic member 530, a manual supplying supporter elastic member 540, a manual supplying supporter 550 and a manual feeding roller 560.

The printing medium P is loaded on the manual supplying supporter 550, and the manual supplying supporter 550 is elastically biased upwardly by the manual supplying supporter elastic member 540. The manual pickup roller 510 picks up the printing medium P loaded on the manual supplying supporter 550, and the picked up printing medium is individually separated by the friction pad 520 to be transported to the manual feeding roller 560.

The manual feeding roller 560 is provided as a pair of rollers, and transports the picked up printing medium to the aligning member 210. Accordingly, the manual supplying apparatus 500 can supply the printing medium P to the aligning member 210 along a manual supplying path C.

As illustrated in FIG. 5, the manual feeding roller 560 may be provided in an area of the printing medium apparatus 100 in which the double-sided printing path D of the double-sided printing guiding member 107 and the manual supplying path C overlap with each other so that the one side printed printing medium transported along the double-sided printing path D, described above, can be easily transported to the aligning member 210.

As necessary, the printing medium aligning unit 200 may further include an aligning member frame 230 coupled to the unit main body 201 to surround an outer surface of the aligning member 210.

If the printing medium P is entangled around the aligning member 210 and jammed during printing, especially, if the printing medium is jammed between the manual feeding roller 560 and the aligning member 210, the user may easily detach the printing medium supplying apparatus 100 from the image forming apparatus to remove the jammed printing medium P. Then, as illustrated in FIGS. 6 and 7, the user may rotate the printing medium aligning unit 200 to the distanced position to simply remove the printing medium jammed therebetween.

As illustrated in FIGS. 5 to 7, the printing medium aligning unit 200 is disposed to rotate from the aligning position to the distanced position with respect to the apparatus main body 101. Alternatively, the printing medium aligning unit 200 may be provided to slidably move as necessary. Also, other moving arrangements may be employed as long as the printing medium aligning unit 200 can move between the aligning position at which the printing medium aligning unit 200 aligns the printing medium, and the distanced position at which the printing medium aligning unit 200 is distanced from the aligning position to facilitate removal of a jammed printing medium, a repair or the like.

Figure 8:
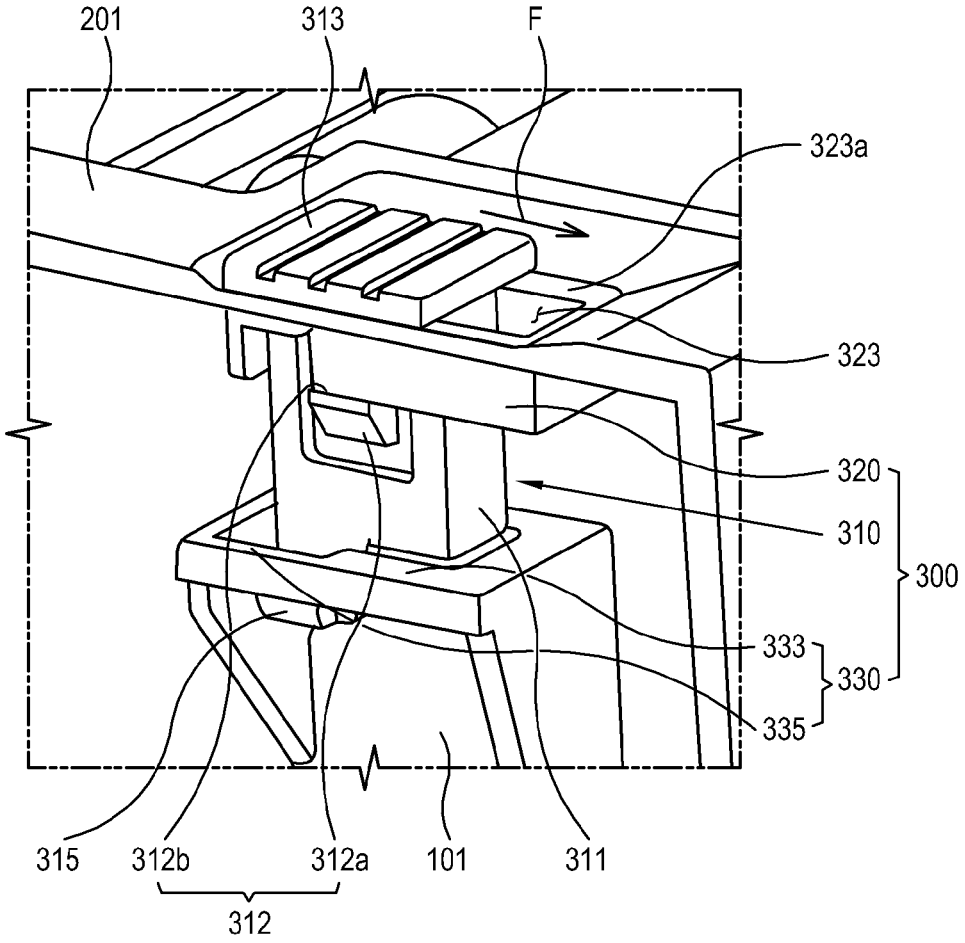
FIG. 8 is a schematic perspective view of a locking unit of the printing medium supplying apparatus of FIG. 2.

As illustrated in FIGS. 2 and 8, the printing medium supplying apparatus 100 according to a present exemplary embodiment of the present general inventive concept may further include a locking unit 300 to lock and release the printing medium aligning unit 200 to and from the printing medium supplying apparatus 100.

As illustrated in FIG. 2, the locking unit 300 may be respectively disposed on opposite sides of the unit main body 201. Alternatively, the locking unit 300 may be disposed at a single location, as necessary.

The locking unit 300 includes a moving member 310 and a stationary member 330.

The moving member 310 is disposed on the unit main body 201 to move between a locking position to lock the printing medium aligning unit 200 to the printing medium supplying apparatus 100, and a locking withdrawing position to withdraw the locking. Also, the locking unit 300 may further include a moving member stopper 320 to prevent the moving member 310 from being separated from the unit main body 201.

The moving member 310 may further include a contact unit 313 exposed to the outside to be contacted by a user, a unit main body mounting unit 312 to prevent the moving member 310 from being separating from the unit main body 201 even though the printing medium aligning unit 200 is moved, and an engagement protrusion 315. In this embodiment, the moving member 310 may be integrally formed by taking into consideration ease of assembly. Also, the moving member 310 may be formed of material having elasticity such as plastics, rubber, etc. so that the unit main body mounting unit 312 can be inserted easily within a guide groove 323 during assembly.

The moving member stopper 320 downwardly protrudes from the unit main body 201. The moving member stopper 320 includes the guide groove 323 into which a main body 311 of the moving member 310 is inserted during assembly. The guide groove 323 guides the moving member 310 to slidably move between the locking position and the locking withdrawing position. The moving member stopper 320 may be integrally formed with the unit main body 201 by taking into consideration ease of assembly.

The unit main body mounting unit 312 includes a taper surface 312*a* and a unit main body engagement part 312*b*. The taper surface 312*a* enables the unit main body mounting unit 312 to easily penetrate the guide groove 323 during assembly, and is elastically restored after the penetration so that the unit main body engagement part 312*b* can be engaged with the moving member stopper 320 to prevent the moving member 310 from being upwardly separated from the unit main body 201.

The contact unit 313 is supported to a circumference 323*a* formed around the guide groove 323 so that the moving member 310 can be prevented from being downwardly separated from the unit main body 201. Accordingly, an up and down direction separation of the moving member 310 can be prevented, and the moving member 310 can slidably move along the guide groove 323.

The engagement protrusion 315 is engaged with the stationary member 330 to lock the printing medium aligning unit 200 to the apparatus main body 101. The engagement protrusion 315 may protrude toward the main body 311, as illustrated in FIG. 8.

The stationary member 330 may be disposed on the apparatus main body 101. The stationary member 330 may include an engagement protrusion insertion unit 335 through which the engagement protrusion 315 is inserted during assembly, and a separation obstructing unit 333 extending from the engagement protrusion insertion unit 335 to face the engagement protrusion 315 to obstruct separation of the engagement protrusion 315 as the inserted engagement protrusion 315 slidably moves. That is, the separation obstructing unit 333 and the engagement protrusion insertion unit 335 are positioned to respectively correspond to the locking position and the locking withdrawing position. In this embodiment, the engagement protrusion insertion unit 335 allows separation of the engagement protrusion 315, and may be referred to as a separation allowing unit.

Figure 9:
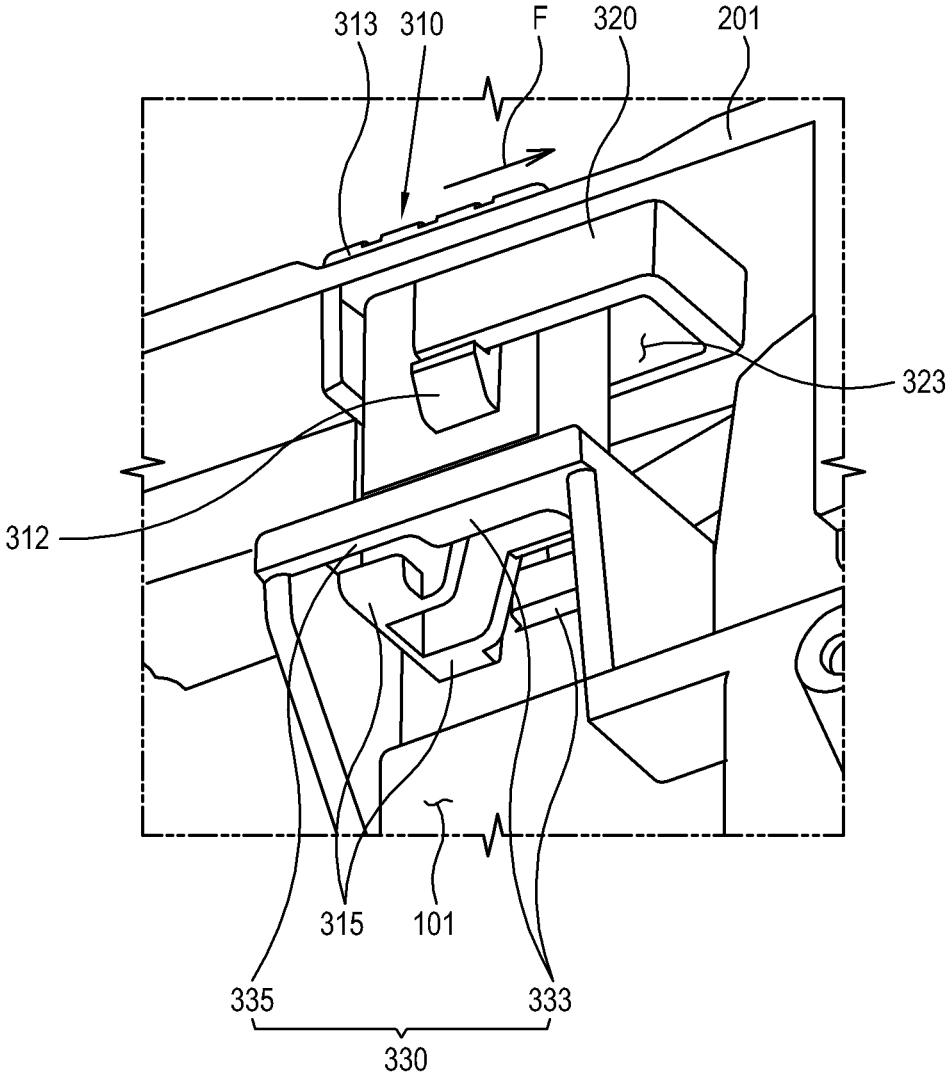
FIG. 9 is a rear perspective view of the locking unit of FIG. 8.

As illustrated in FIG. 9, the moving member 310 is positioned at the locking withdrawing position, and is capable of rotating together with the unit main body 201 if a user upwardly rotates the unit main body 201. As illustrated in FIG. 9, if the user slidably moves the contact unit 313 in a direction F, the engagement protrusion 315 of the moving member 310 engages the separation obstructing unit 333 to lock the printing medium aligning unit 200 to the apparatus main body 101 in the locking position. Accordingly, although the user may rotate the printing medium aligning unit 200 by mistake, or if an unexpected situation happens during printing, the printing medium aligning unit 200 can be positioned at the aligning position to align the printing medium as long as the moving member 310 is positioned at the locking position.

If the printing medium is jammed, or if a repair is needed, a user slidably moves the moving member 310 to the locking withdrawing position, and then rotates the printing medium aligning unit 200 to expose an inner part of the printing medium aligning unit 200 to the outside to remove a jammed printing medium P.

As illustrated in FIGS. 8 and 9, the separation allowing unit 335 and the separation obstructing unit 333 are of a groove type. Alternatively, the separation allowing unit 335 and the separation obstructing unit 333 may be of a protrusion type, or other types, as long as the separation of the engagement protrusion 315 can be both allowed and obstructed. Also, alternatively, the moving member 310 and the stationary member 330 may be respectively formed on the apparatus main body 101 and the unit main body 201.

Hereinafter, a locking unit 400 having a different type from the locking unit 300 described above will be described by referring to FIGS. 10A through 10C, and FIG. 11.

The locking unit 400 includes a moving member 410, a stationary member 430 and an automatic locking unit 440.

The moving member 410 includes a main body 411, a contact unit 413, an engagement protrusion 415 and a taper unit 417. The main body 411, the contact unit 413 and the engagement protrusion 415 may have the same configurations as the main body 311, the contact unit 313 and the engagement protrusion 315 illustrated in FIGS. 8 and 9. The moving member 410 may further include the unit main body mounting unit 312 on FIG. 8 to rotate together with the unit main body 201 with respect to the apparatus main body 101.

Figure 10A:
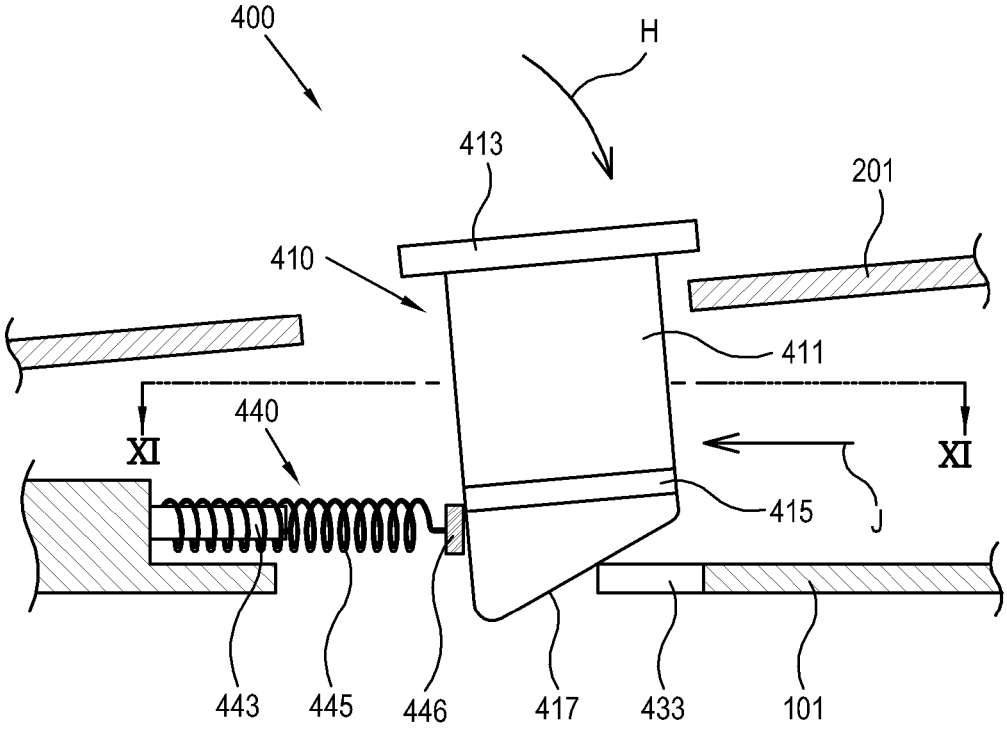
FIGS. 10A through 10C are schematic sectional views illustrating an operating process of the locking unit of the present general inventive concept automatically moving to a locking position.
Figure 10B:
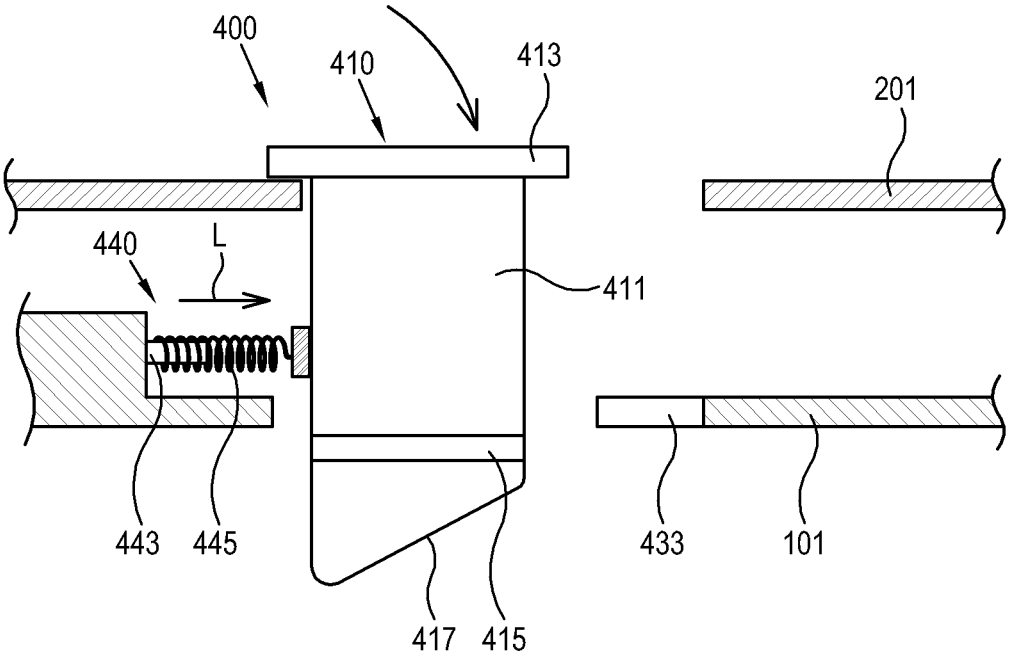

Referring to FIG. 10A, when the unit main body 201 rotates from the distanced position to the aligning position in a direction H, the taper unit 417 contacts a separation obstructing unit 433 of the stationary member 430 and enables the moving member 410 to slidably move in a direction J. Accordingly, as illustrated in FIG. 10B, the moving member 410 can be inserted through a separation allowing unit 435 of the stationary member 430 during assembly.

The stationary member 430 includes the separation allowing unit 435 and the separation obstructing unit 433, and the separation allowing unit 435 and the separation obstructing unit 433 may have the same configurations as the separation allowing unit 335 and the separation obstructing unit 333 illustrated in FIGS. 8 and 9.

The automatic locking unit 440 moves the moving member 410 to the locking position if the unit main body 201 is positioned at the aligning position. The automatic locking unit 440 may be disposed on the apparatus main body 101. Alternatively, the automatic locking unit 440 may be disposed on the unit main body 201.

The automatic locking unit 440 includes an elastic member 445, a boss 443 supporting the elastic member 445, and a pushing plate 446 connected to the elastic member 445 to push the moving member 410 to the locking position by an elastic force of the elastic member 445.

Figure 10C:
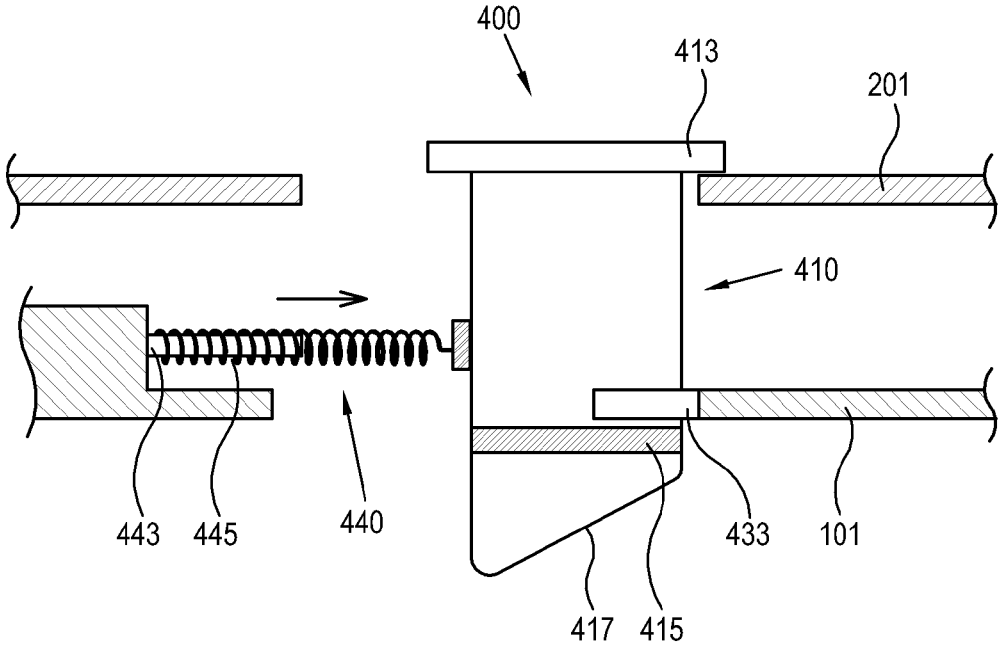
Figure 11:
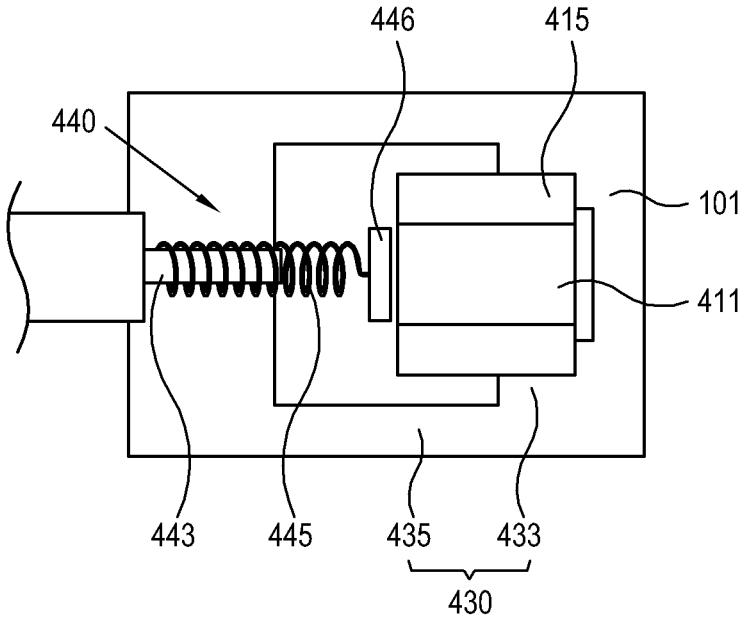
FIG. 11 is a schematic plane view taken along line XI-XI of FIG. 10A.

If the unit main body 201 is positioned at the aligning position, the moving member 410 slidably moves in a direction J, and pushes the pushing plate 446 to engage the separation allowing unit 435. Since the engaged moving member 410 receives the elastic force in a direction L as illustrated in FIG. 10B, the moving member 410 moves to the locking position as illustrated in FIG. 10C. Accordingly, the engagement protrusion 415 interferes with the separation obstructing unit 433 to prevent the engagement protrusion 415 from being upwardly separated from the unit main body 201, that is, the printing medium aligning unit 200 can be automatically locked into place at the aligning position.

For the locking unit 300 as illustrated in FIGS. 8 and 9, the user manually moves the moving member 310 to the locking position to lock the printing medium aligning unit 200 to the apparatus main body 101 after positioning the printing medium aligning unit 200 at the aligning position. On the other hand, in an embodiment employing the automatic locking unit 440, if the user moves the printing medium aligning unit 200 to the aligning position, the moving member 410 can be automatically moved to the locking position. Accordingly, convenience for the user can be improved.

As described above, a printing medium supplying apparatus and an image forming apparatus having the same according to the present general inventive concept have, at a minimum, the following effects:

First, a printing medium aligning unit is disposed on a printing medium supplying apparatus, thereby allowing an image forming apparatus to be small.

Second, a printing medium aligning unit is disposed on a printing medium supplying apparatus to move between an aligning position and a distanced position, thereby allowing a jammed printing medium to be easily removed, and allowing maintenance work to be more easily facilitated.

Third, a printing medium aligning unit and a printing medium supplying apparatus may be integrally modularized, thereby improving productivity.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. A printing medium supplying apparatus for an image forming apparatus, comprising:

an apparatus main body; and a printing medium aligning unit rotatably disposed on the apparatus main body capable of aligning printing media received from multiple directions and comprising:

a plurality of aligning rollers that face each other to align a front end part of a printing medium; and a unit main body which supports the aligning rollers, wherein the printing medium supplying apparatus is configured to be detachably mountable to the image forming apparatus, and wherein the apparatus main body is configured to have a feeding path through which a printing medium picked up by a pickup roller is fed to the aligning rollers, a double-sided printing path through which a one side printed printing medium is fed to the aligning rollers and a manual supplying path through which a printing medium supplied by a manual supplying apparatus is fed to the aligning rollers.

2. The printing medium supplying apparatus according to claim 1, further comprising:

a locking unit to lock and to release the unit main body to and from the apparatus main body.

3. The printing medium supplying apparatus according to claim 2, wherein the locking unit comprises:

a moving member which is provided on one of the apparatus main body and the unit main body to move between a locking position at which the unit main body is locked to the apparatus main body and a locking withdrawing position at which the unit main body is released from the apparatus main body; and a stationary member which is provided on one of the apparatus main body and the unit main body to engage with and to separate from the moving member.

4. The printing medium supplying apparatus according to claim 3, wherein the moving member is disposed on the unit main body to slidably move.

5. The printing medium supplying apparatus according to claim 3, further comprising:

an elastic member to elastically bias the moving member toward the locking position.

6. The printing medium supplying apparatus according to claim 1, wherein the printing medium aligning unit rotates on a hinge shaft of the apparatus main body.

7. The printing medium supplying apparatus according to claim 6, further comprising:

a hinge pivot which is provided on one of the apparatus main body and the printing medium aligning unit, and a supporter which comprises:

a hinge pivot insertion unit to allow the hinge pivot to be inserted therethrough; and a support unit- to support the hinge pivot.

8. The printing medium supplying apparatus according to claim 1, wherein the apparatus main body further comprises at least one of a manual pickup roller to pick up the printing medium to being transported through the manual supplying path and a duplex feeding roller disposed in the double-sided printing path and to transport the one side printed printing medium to the aligning rollers.

9. An image forming apparatus, comprising:

an image forming unit to form an image on a printing medium; and a printing medium supplying apparatus to supply the printing medium to the image forming unit, comprising:

an apparatus main body; and a printing medium aligning unit rotatably disposed on the apparatus main body capable of aligning printing media received from multiple directions and comprising:

a plurality of aligning rollers that face each other to align a front end part of a printing medium; and a unit main body which supports the aligning rollers, wherein the printing medium supplying apparatus is configured to be detachably mountable to the image forming apparatus, and wherein the apparatus main body is configured to have a feeding path through which a printing medium picked up by a pickup roller is fed to the aligning rollers, a double-sided printing path through which a one side printed printing medium is fed to the aligning rollers and a manual supplying path through which a printing medium supplied by a manual supplying apparatus is fed to the aligning rollers.

10. The image forming apparatus according to claim 9, further comprising:

a locking unit to lock and to release the unit main body to and from the apparatus main body.

11. The image forming apparatus according to claim 10, wherein the locking unit comprises:

a moving member which is provided on one of the apparatus main body and the unit main body to move between a locking position at which the unit main body is locked to the apparatus main body and a locking withdrawing position at which the unit main body is released from the apparatus main body; and a stationary member which is provided to engage with and separate from the moving member.

12. The image forming apparatus according to claim 11, wherein the moving member is disposed on the unit main body to slidably move.

13. The image forming apparatus according to claim 11, wherein the locking unit further comprises:

an automatic locking unit to move the moving member to the locking position as the unit main body moves to the aligning position.

14. The image forming apparatus according to claim 13, wherein the automatic locking unit further comprises:

an elastic member to elastically bias the moving member toward the locking position.

15. The image forming apparatus according to claim 9, further comprising:

a hinge pivot which is provided on one of the apparatus main body and the printing medium aligning unit; and a supporter which comprises:

a hinge pivot insertion unit which is provided to allow the hinge pivot to be inserted therethrough; and a support unit to support the hinge pivot.

16. The image forming apparatus according to claim 9, wherein the double-sided printing path is formed inside the image forming apparatus to guide the printing medium which has been printed on one side to be printed on the opposite side by the image forming unit and the manual supplying path is formed inside the image forming apparatus to guide a printing medium which is loaded on a manual supplying supporter are overlapped, and then connected to the aligning roller.

17. The image forming apparatus according to claim 9, wherein the manual supplying apparatus is coupled to the printing medium aligning unit along a substantially horizontal direction, and the manual supplying apparatus comprises the manual supplying path through which a printing medium is fed toward the image forming unit via the aligning roller.

18. The image forming apparatus according to claim 17, wherein the printing medium which has been printed on one side thereof is fed toward the aligning roller through the double-sided printing path.

19. A printing medium supplying apparatus for an image forming apparatus, comprising:

an apparatus main body; and a printing medium aligning unit disposed on the apparatus main body capable of aligning printing media received from multiple directions and comprising:

a plurality of aligning rollers that face each other to align a front end part of a printing medium;

a unit main body which supports the aligning rollers; and a locking unit to lock and to release the unit main body to and from the apparatus main body, wherein:

the printing medium supplying apparatus is configured to be detachably mountable to the image forming apparatus;

the apparatus main body is configured to have a feeding path through which a printing medium picked up by a pickup roller is fed to the aligning rollers, a double-sided printing path through which a one side printed printing medium is fed to the aligning rollers and a manual supplying path through which a printing medium supplied by a manual supplying apparatus is fed to the aligning rollers;

the locking unit comprises:

a moving member which is provided on one of the apparatus main body and the unit main body to move between a locking position at which the unit main body is locked to the apparatus main body and a locking withdrawing position at which the unit main body is released from the apparatus main body; and a stationary member which is provided on one of the apparatus main body and the unit main body to engage with and to separate from the moving member;

the moving member comprises:

an engagement protrusion; and the stationary member comprises:

a separation allowing unit which is provided at the locking withdrawing position to allow separation of the engagement protrusion; and a separation obstructing unit which is provided at the locking position to obstruct separation of the engagement protrusion.

20. A printing medium supplying apparatus for an image forming apparatus, comprising:

an apparatus main body; and a printing medium aligning unit disposed on the apparatus main body capable of aligning printing media received from multiple directions and comprising:

a plurality of aligning rollers that face each other to align a front end part of a printing medium; and a unit main body which supports the aligning rollers, wherein:

the printing medium supplying apparatus is configured to be detachably mountable to the image forming apparatus;

the apparatus main body is configured to have a feeding path through which a printing medium picked up by a pickup roller is fed to the aligning rollers, a double-sided printing path through which a one side printed printing medium is fed to the aligning rollers and a manual supplying path through which a printing medium supplied by a manual supplying apparatus is fed to the aligning rollers; and the unit main body is coupled to the apparatus main body to move together with the aligning rollers between an aligning position at which the aligning rollers align the printing medium received from multiple directions and a distanced position at which the aligning rollers are distanced from the aligning position.

21. An image forming apparatus, comprising:

an image forming unit to form an image on a printing medium; and a printing medium supplying apparatus to supply the printing medium to the image forming unit, comprising:

an apparatus main body; and a printing medium aligning unit disposed on the apparatus main body capable of aligning printing media received from multiple directions and comprising:

a plurality of aligning rollers that face each other to align a front end part of a printing medium;

a unit main body which supports the aligning rollers; and a locking unit to lock and to release the unit main body to and from the apparatus main body, wherein:

the printing medium supplying apparatus is configured to be detachably mountable to the image forming apparatus;

the apparatus main body is configured to have a feeding path through which a printing medium picked up by a pickup roller is fed to the aligning rollers, a double-sided printing path through which a one side printed printing medium is fed to the aligning rollers and a manual supplying path through which a printing medium supplied by a manual supplying apparatus is fed to the aligning rollers;

the locking unit comprises:

a moving member which is provided on one of the apparatus main body and the unit main body to move between a locking position at which the unit main body is locked to the apparatus main body and a locking withdrawing position at which the unit main body is released from the apparatus main body; and a stationary member which is provided to engage with and separate from the moving member;

the moving member comprises:

an engagement protrusion; and the stationary member comprises:

a separation allowing unit which is provided on the locking withdrawing position to allow separation of the engagement protrusion; and a separation obstructing unit which is provided in the locking position to obstruct separation of the engagement protrusion.

22. A printing medium supplying device usable with an image forming apparatus, comprising:

a printing medium supplying device main body;

an aligning unit rotatably disposed on the printing medium supplying device main body capable of aligning printing media received from multiple directions for printing on the printing media and comprising:

a plurality of aligning rollers forming a nip and configured to receive a printing medium therebetween to align a front end part of the printing medium; and a unit main body which supports the aligning rollers;

a movable locking unit to lock and unlock the aligning unit to and from the printing medium supplying device main body, the movable locking unit comprising:

a stationary member; and a moving member to move in relation to the stationary member and having an engagement protrusion portion to engage with the stationary member to prevent separation of the engagement protrusion portion from the stationary member as the moving member moves, wherein the printing medium supplying device is configured to be detachably mountable to the image forming apparatus, and wherein the printing medium supplying device main body is configured to have a feeding path through which a printing medium picked up by a pickup roller is fed to the aligning rollers, a double-sided printing path through which a one side printed printing medium is fed to the aligning rollers and a manual supplying path through which a printing medium supplied by a manual supplying apparatus is fed to the aligning rollers.

* * * * *